US011324315B2

(12) United States Patent
Wu et al.

(10) Patent No.: US 11,324,315 B2
(45) Date of Patent: May 10, 2022

(54) REFRIGERATOR

(71) Applicants: Qingdao Haigao Design & Manufacturing Co., Ltd., Shandong (CN); Haier Smart Home Co., Ltd., Shandong (CN)

(72) Inventors: Jian Wu, Shandong (CN); Shu Zhou, Shandong (CN); Zhaojun Fei, Shandong (CN); Zuowei Yi, Shandong (CN); Zhiqun Feng, Shandong (CN); Hui An, Shandong (CN); Yi Huang, Shandong (CN)

(73) Assignees: QINGDAO HAIGAO DESIGN & MANUFACTURING CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/315,709

(22) Filed: May 10, 2021

(65) Prior Publication Data

US 2021/0401171 A1 Dec. 30, 2021

Related U.S. Application Data

(63) Continuation of application No. PCT/CN2020/128385, filed on Nov. 12, 2020.

(51) Int. Cl.

| | |
|---|---|
| ***A47B 88/00*** | (2017.01) |
| ***A47B 88/403*** | (2017.01) |
| ***F25D 13/02*** | (2006.01) |

(52) U.S. Cl.

CPC ..... *A47B 88/403* (2017.01); *F25D 13/02* (2013.01)

(58) Field of Classification Search

CPC ..... A47B 88/403; A47B 88/02; A47B 88/04; A47B 88/0014; A47B 2088/0403; A47B 71/00; A47B 67/00; A47B 67/04; F25D 13/02

USPC ..... 312/402, 404, 348.1, 348.2, 283, 330.1, 312/296, 348.6, 286, 287; 62/382

See application file for complete search history.

(56) References Cited

U.S. PATENT DOCUMENTS 1,469,359 A * 10/1923 Craw ..... A47B 77/16 232/1 R
2,198,239 A * 4/1940 Baird ..... F25D 13/02 62/382

(Continued)

FOREIGN PATENT DOCUMENTS

CH 589211 * 6/1975
DE 3231432 * 4/1983

(Continued)

*Primary Examiner* — Janet M Wilkens
(74) *Attorney, Agent, or Firm* — Calfee, Halter & Griswold LLP

(57) ABSTRACT

A refrigerator includes a housing, a plurality of openings and a drawer. The housing includes a plurality of side surfaces which define an accommodating cavity. The plurality of openings are respectively formed in different side surfaces. The drawer is arranged in the accommodating cavity and can be pulled out along any one of the plurality of openings. The drawer is arranged in the accommodating cavity so that a user can pull out the drawer to take and place food from the openings located in different side surfaces of the housing.

17 Claims, 7 Drawing Sheets

(56) References Cited

U.S. PATENT DOCUMENTS

| | | | | | |
|---|---|---|---|---|---|
| 2,404,851 | A * | 7/1946 | Knowles | F25D 25/025 312/286 |
| 3,285,685 | A * | 11/1966 | Hewett | A47B 67/005 312/287 |
| 4,002,385 | A * | 1/1977 | Hone | A47B 53/00 312/286 |
| 4,317,607 | A * | 3/1982 | Gomolka | F25D 13/04 312/236 |
| 4,991,912 | A * | 2/1991 | Fox | B65F 1/00 312/236 |
| 8,757,458 | B2 * | 6/2014 | Nebel | B60R 9/00 224/404 |
| 2015/0022067 | A1 * | 1/2015 | Lee | A47B 88/40 312/236 |

FOREIGN PATENT DOCUMENTS

| | | | |
|---|---|---|---|
| DE | 19908843 | * | 9/2000 |
| FR | 2604354 | * | 4/1988 |
| JP | 2004188110 | * | 7/2004 |
| WO | 2018143261 | * | 8/2018 |

* cited by examiner

REFRIGERATOR

CROSS-REFERENCE TO RELATED APPLICATIONS

This application is a bypass continuation of PCT Application No. PCT/CN2020/128385, filed on Nov. 12, 2020, which claims priority to China Patent Application No. 202010614894.9, filed on Jun. 30, 2020 in China Patent Office, which are hereby incorporated by reference in their entirety.

TECHNICAL FIELD

The present disclosure relates to the technical field of household appliances, for example, relates to a refrigerator.

BACKGROUND

A refrigerator is refrigeration equipment that maintains a constant low temperature. It is a household appliance commonly used in daily life to preserve food or other items. People need to preserve food or other items in the refrigerator in daily life, and open the refrigerator to take out the food from one side of the refrigerator when they need to take out food.

In the process of implementing the embodiments of the present disclosure, it is found that at least the following problems exist in the related art:

the food can only be taken from one side of the refrigerator, which is not convenient for taking and placing food.

SUMMARY

In order to gain a basic understanding for some aspects of the disclosed embodiments, a brief summary is provided below. The summary is not a general comment, nor is it intended to determine the key/important component elements or describe the protection scope of these embodiments, but serves as a prelude to the detailed description that follows.

The embodiment of the present disclosure provides a refrigerator to solve the problem that food can only be taken from one side of a refrigerator, which is not convenient for taking and placing food.

In some embodiments, the refrigerator includes: a housing, a plurality of openings and a drawer. The housing includes a plurality of side surfaces which define an accommodating cavity; the plurality of openings are respectively formed in different side surfaces; the drawer is arranged in the accommodating cavity, and can be pulled out along any one of the plurality of openings.

The refrigerator provided by the embodiment of the present disclosure can achieve the following technical effects:

The drawer is arranged in the accommodating cavity, so that a user can pull out the drawer to take and place food from the openings located in different side surfaces of the housing. Therefore, the user can take and place the food on different sides of the refrigerator, which is convenient for taking and placing the food and enhances the experience of the user.

The above general description and the following description are only exemplary and explanatory, and are not used to limit this application.

BRIEF DESCRIPTION OF THE DRAWINGS

One or more embodiments are exemplified by the corresponding accompanying drawings. These exemplified descriptions and drawings do not constitute a limitation to the embodiments. Elements with the same reference numerals in the drawings are shown as similar elements. The drawings do not constitute a scale limitation, and in the drawings.

NUMERALS IN THE DRAWINGS

Figure 1:
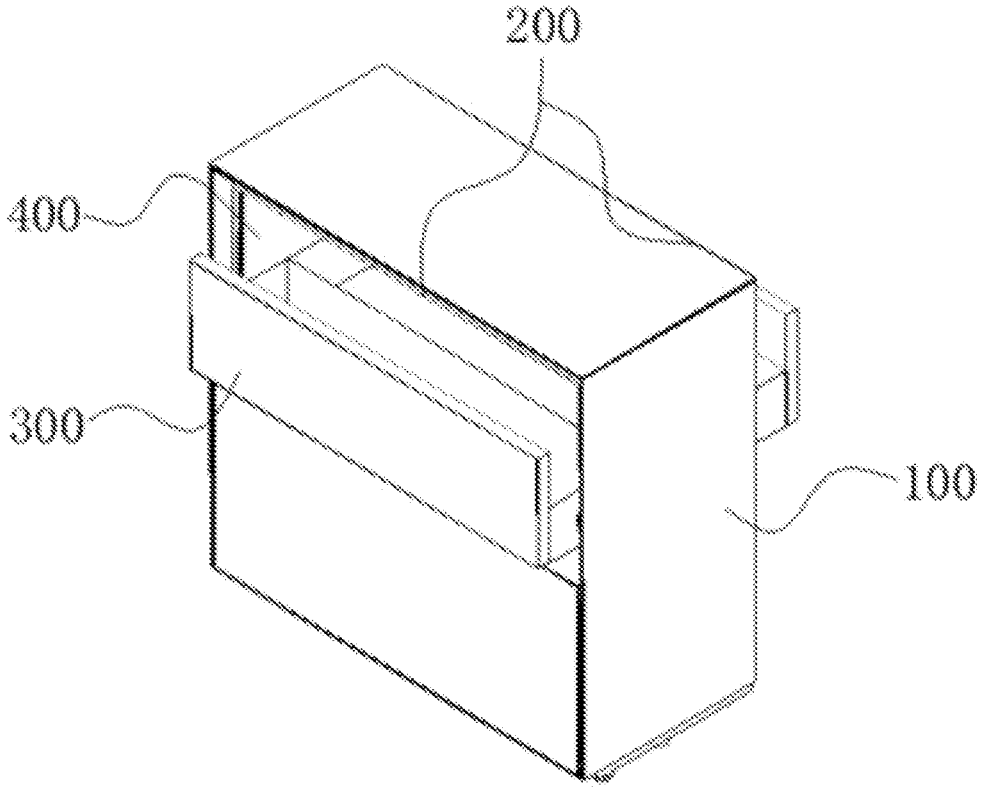
FIG. 1 is a schematic structural diagram of a refrigerator provided by the embodiments of the present disclosure.
Figure 2:
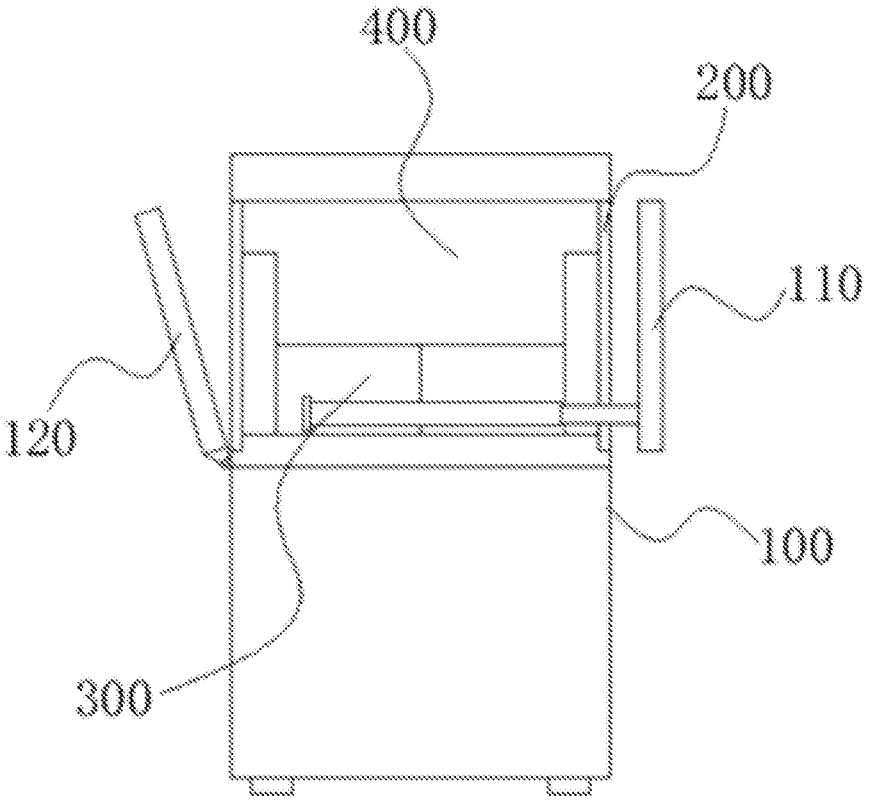
FIG. 2 is a schematic structural diagram of another refrigerator provided by the embodiments of the present disclosure.
Figure 3:
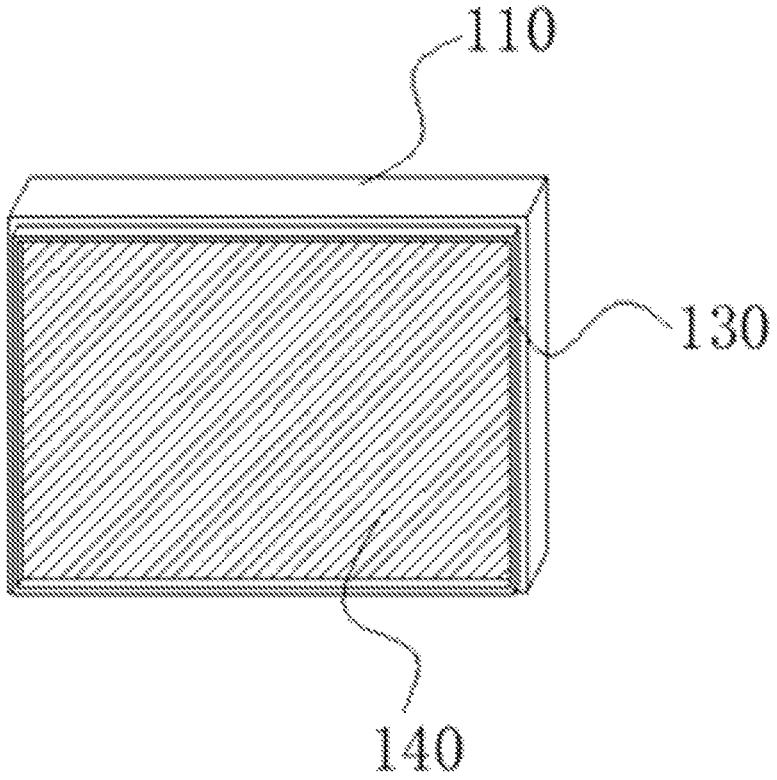
FIG. 3 is a schematic structural diagram of a first sealing door provided by the embodiments of the present disclosure.
Figure 4:
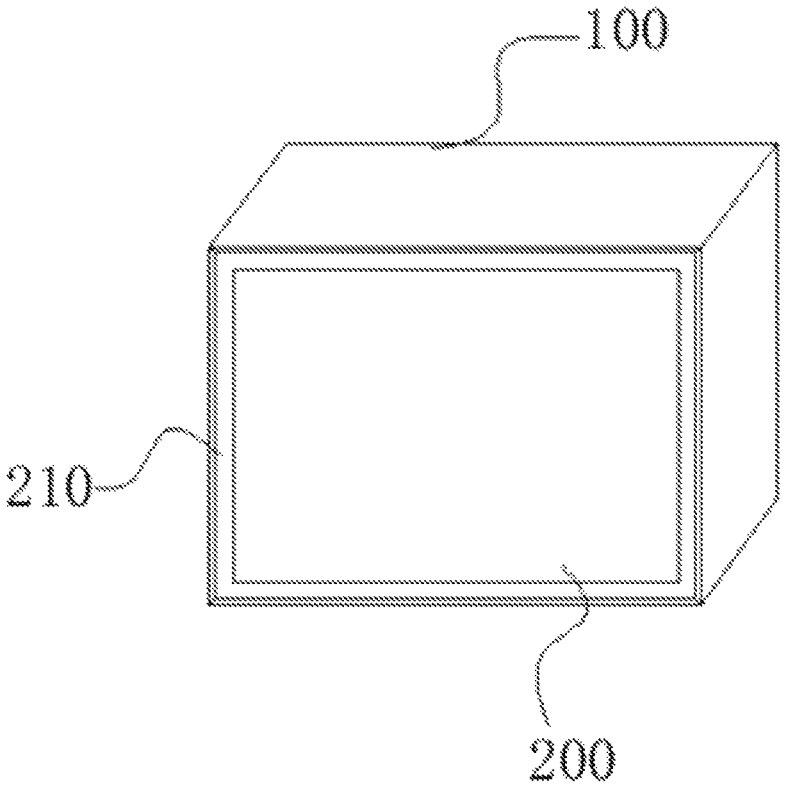
FIG. 4 is a schematic structural diagram of an opening provided by the embodiments of the present disclosure.
Figure 5:
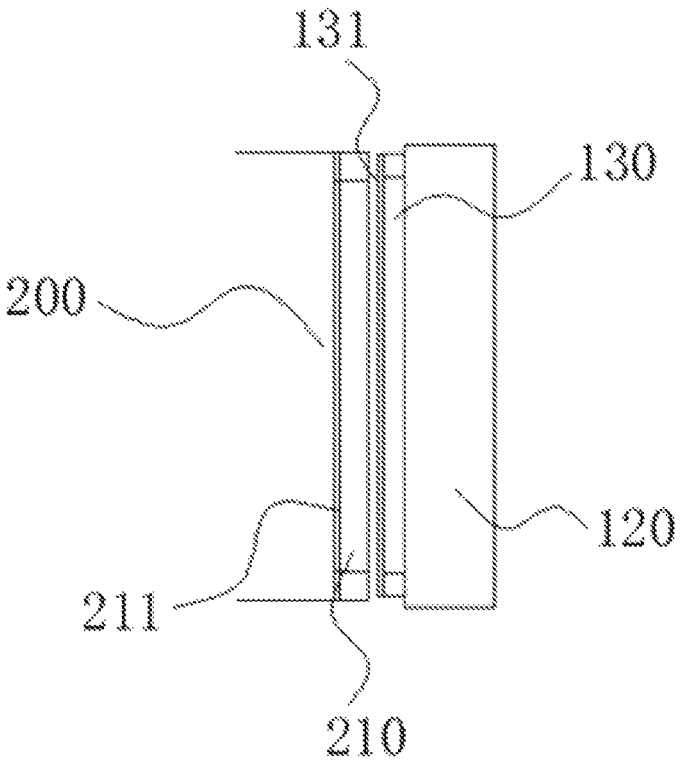
FIG. 5 is a schematic structural diagram of an adsorption strip and an adsorption gasket provided by the embodiments of the present disclosure.

100: housing; 110: first sealing door; 120: second sealing door; 130: protrusion; 131: an adsorption strip; 140: thermal insulation layer; 150: penetration slot; 151: sealing pad; 200: opening; 210: groove; 211: adsorption gasket; 300: drawer; 310: storage box; 320: thermal insulation plate; 321: handle; 322: antiskid sleeve; 400: accommodating cavity; 410: heat exchange slot; 411: fan; 412: air duct; 500: telescopic structure; 510: collection part; 520: telescopic part; 600: refrigeration part.

DETAILED DESCRIPTION

In order to understand the features and technical contents of the embodiments of the present disclosure in more details, the implementation of the embodiments of the present disclosure will be described in detail below with reference to the accompanying drawings. The accompanying drawings are for reference only and are not intended to limit the embodiments of the present disclosure. In the following technical description, for the convenience of explanation, a number of details are used to provide a sufficient understanding of the disclosed embodiments. However, one or more embodiments can still be implemented without these details. In other cases, in order to simplify the drawings, well-known structures and devices may be simplified for display.

The terms "first", "second", etc. in the description and claims of the embodiments of the present disclosure and the above-mentioned drawings are used to distinguish similar objects, and are not necessarily used to describe a specific sequence or a precedence order. It should be understood that the data used in this way can be interchanged under appropriate circumstances for the purposes of the embodiments of the present disclosure described herein. In addition, the terms "include" and "has" and any variations of them are intended to cover non-exclusive inclusions.

In the embodiments of the present disclosure, orientations or positional relationship indicated by the terms "upper", "lower", "inner", "middle", "outer", "front", "rear", etc. are based on the orientations or positional relationships shown in the drawings. These terms are mainly used to better describe the embodiments of the present disclosure and the embodiments thereof, and are not used to limit that the indicated device, element, or component must have a specific orientation, or be constructed and operated in a specific orientation. In addition, some of the above terms may be used to indicate other meanings in addition to the orientations or position relationships. For example, the term "upper" may also be used to indicate a certain dependence relationship or connection relationship in some cases. For those of ordinary skill in the art, the specific meanings of these terms in the embodiments of the present disclosure can be understood according to specific situations.

In addition, the terms "arrange", "connect", and "fix" should be interpreted broadly. For example, "connection" can be a fixed connection, a detachable connection, or an integral structure. It can be a mechanical connection or an electrical connection. It can be a direct connection, or an indirect connection through an intermediate medium, or a communication between two devices, components or components. For those of ordinary skill in the art, the specific meanings of the above terms in the embodiments of the present disclosure can be understood according to specific situations.

Unless otherwise stated, the term "plurality" means two or more.

In the embodiments of the present disclosure, the character "/" indicates that the preceding and following objects are in an "or" relationship. For example, A/B means: A or B.

The term "and/or" is a kind of association relationship describing objects, which means that there can be three kinds of relationships. For example, A and/or B means: A or B, or, A and B.

It should be noted that, in the case of no conflict, the embodiments in the embodiments of the present disclosure and the features in the embodiments can be combined with each other.

In combination with FIG. 1 to FIG. 5, in some embodiments, a refrigerator includes a housing 100, a plurality of openings 200 and a drawer 300. The housing 100 includes a plurality of side surfaces which define an accommodating cavity 400; the plurality of openings 200 are respectively formed in different side surfaces; and the drawer 300 are arranged in the accommodating cavity 400, and can be pulled out along any one of the plurality of openings 200.

By the adoption of the refrigerator provided by the embodiments of the present disclosure, the plurality of side surfaces of the housing 100 are all provided with the openings 200, and the drawer 300 is arranged in the accommodating cavity 400, so that a user can pull out the drawer 300 to take and place food from the openings 200 located in different side surfaces of the housing 100. Therefore, the user can take and place the food on different sides of the refrigerator, which is convenient for taking and placing the food and enhances the experience of the user.

Optionally, the refrigerator further includes a first sealing door 110 and a second sealing door 120. The first sealing door 110 is connected to the drawer 300 and can be pulled out along with the drawer 300, or is connected to the housing 100 and can be flipped along the housing 100 to be opened, and is configured to close one opening 200 of the accommodating cavity 400. The second sealing door 120 is connected to the drawer 300 and can be pulled out along with the drawer 300, or is connected to the housing 100 and can be flipped along the housing 100 to be opened, and is configured to close one opening 200 of the accommodating cavity 400. In this way, the openings 200 located on the side surfaces of the housing 100 can be sealed through the first sealing door 110 and the second sealing door 120 to reduce the cold loss in the accommodating cavity 400. The user can open the first sealing door 110 and/or the second sealing door 120 to open the openings 200 closed by the first sealing door 110 and/or the second sealing door 120 and take and place the food from the openings 200 when they need to take and place food from the drawer 300 in the accommodating cavity 400, which is convenient for taking and placing the food, and enhances the experience of the user.

Optionally, the first sealing door 110 and/or the second sealing door 120 are connected with the housing 100 through hinges. In this way, the first sealing door 110 and/or the second sealing door 120 can be flipped along the housing 100 to be opened to facilitate taking and placement of the food.

Optionally, both the first sealing door 110 and the second sealing door 120 are of rectangular plate type structures. In this way, the first sealing door 110 and the second sealing door 120 are easy to produce, so that the production cost is reduced.

Optionally, the openings 200 are rectangular. In this way, the first sealing door 110 and the second sealing door 120 seal the openings 200 conveniently to facilitate taking and placement of the food.

Optionally, the side walls, facing the accommodating cavity 400, of the first sealing door 110 and the second sealing door 120 are provided with protrusions 130. In this way, when the first sealing door 110 and the second sealing door 120 close the openings 200, the protrusions 130 can be embedded into the openings 200 to reduce gaps between the first sealing door 110 and the opening 200 as well as between the second sealing door 120 and the opening 200, so that the sealing effect of the first sealing door 110 and the second sealing door 120 is enhanced.

Optionally, the protrusions 130 are of annular protrusion structures, and surround the edges of the side walls of the first sealing door 110 and the second sealing door 120. In this way, the protrusions 130 can be embedded into the openings 200 more firmly, which enhances the sealing effect of the first sealing door 110 and the second sealing door 120.

Optionally, the protrusions 130 are made of a thermal insulation material. In this way, the cold loss in the accommodating cavity 400 can be reduced, and the thermal insulation effect of the first sealing door 110 and the second sealing door 120 can be enhanced.

Optionally, grooves 210 are formed in positions of the openings 200 of the housing 100 and correspond to the protrusions 130. In this way, the protrusions 130 on the side walls of the first sealing door 110 and the second sealing door 120 can be embedded into the grooves 210 to reduce the gaps between the first sealing door 110 and the opening 200 as well as between the second sealing door 120 and the opening 200, so that the sealing effect of the first sealing door 110 and the second sealing door 120 is enhanced.

Optionally, the grooves 210 are of annular groove structures, and surround rims of the openings 200. In this way, the annular protrusions 130 can be better embedded into the annular grooves to reduce the gaps between the first sealing door 110 and the opening 200 as well as between the second sealing door 120 and the opening 200, so that the sealing effect of the first sealing door 110 and the second sealing door 120 is enhanced.

Optionally, adsorption strips 131 are arranged on the protrusions 130. In this way, the first sealing door 110 and the second sealing door 120 are adsorbed at the openings 200 through the adsorption strips 131 to enhance the sealing effect of the first sealing door 110 and the second sealing door 120.

Optionally, adsorption gaskets 211 corresponding to the adsorption strips 131 are arranged in the grooves 210. In this way, adsorption of the adsorption strips 131 is facilitated, so that after the adsorption gaskets 211 and the adsorption strips 131 are adsorbed, the edges of the first sealing door 110 and the second sealing door 120 are sealed, which enhances the sealing effect of the first sealing door 110 and the second sealing door 120.

Optionally, both the adsorption strips 131 and the adsorption gaskets 211 are made of a rubber magnetic material. In this way, the adsorption strips 131 and the adsorption gaskets 211 which are made of the rubber magnetic material have a relatively good adsorption effect and are elastic, so that while enhancing the sealing effect of the first sealing door 110 and the second sealing door 120, they can play a buffer role, reduce collision with the housing 100 when the sealing doors are closed and prolong the service lives of the sealing doors.

Optionally, the side walls, facing the accommodating cavity 400, of the first sealing door 110 and the second sealing door 120 are provided with thermal insulation layers 140. In this way, the cold loss in the accommodating cavity 400 can be reduced, and the thermal insulation effect of the first sealing door 110 and the second sealing door 120 can be enhanced.

Optionally, the thermal insulation layers 140 are polyurethane foam layers. In this way, the polyurethane foam layers are relatively good in thermal insulation effect and relatively low in cost.

Figure 6:
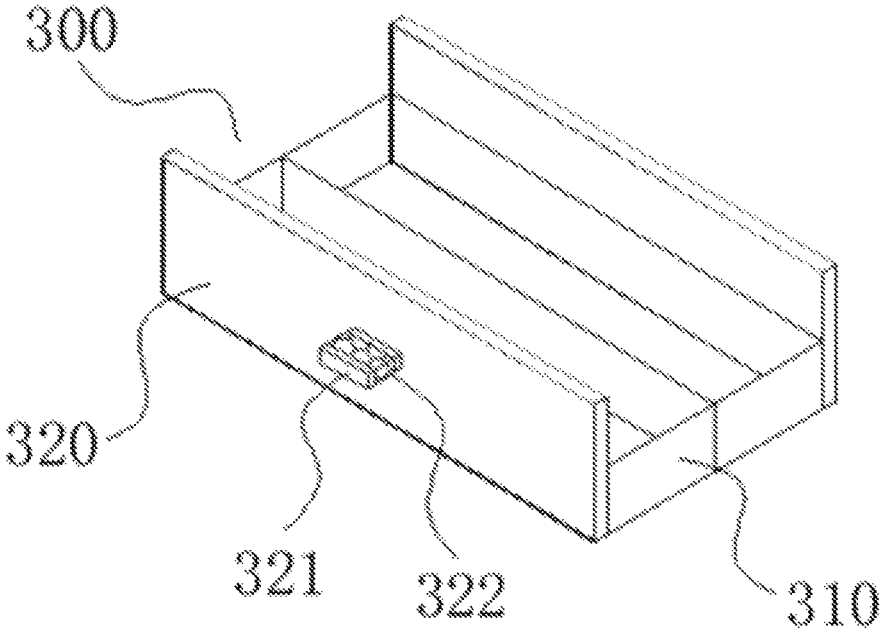
FIG. 6 is a schematic structural diagram of a drawer provided by the embodiments of the present disclosure.
Figure 7:
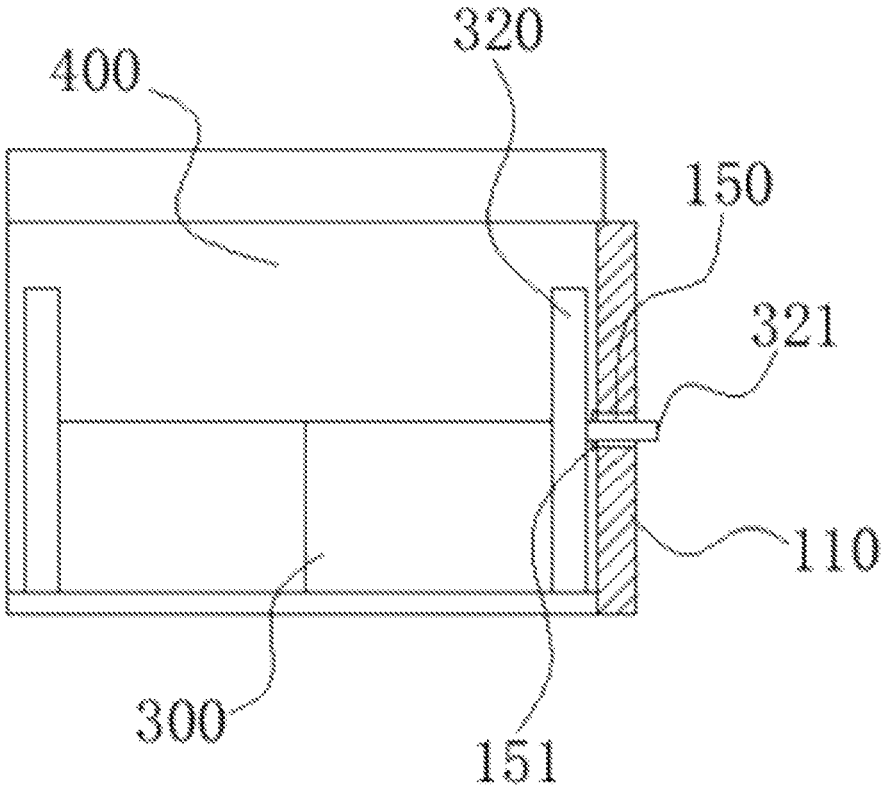
FIG. 7 is a schematic structural diagram of a handle and a penetration slot provided by the embodiments of the present disclosure.
Figure 8:
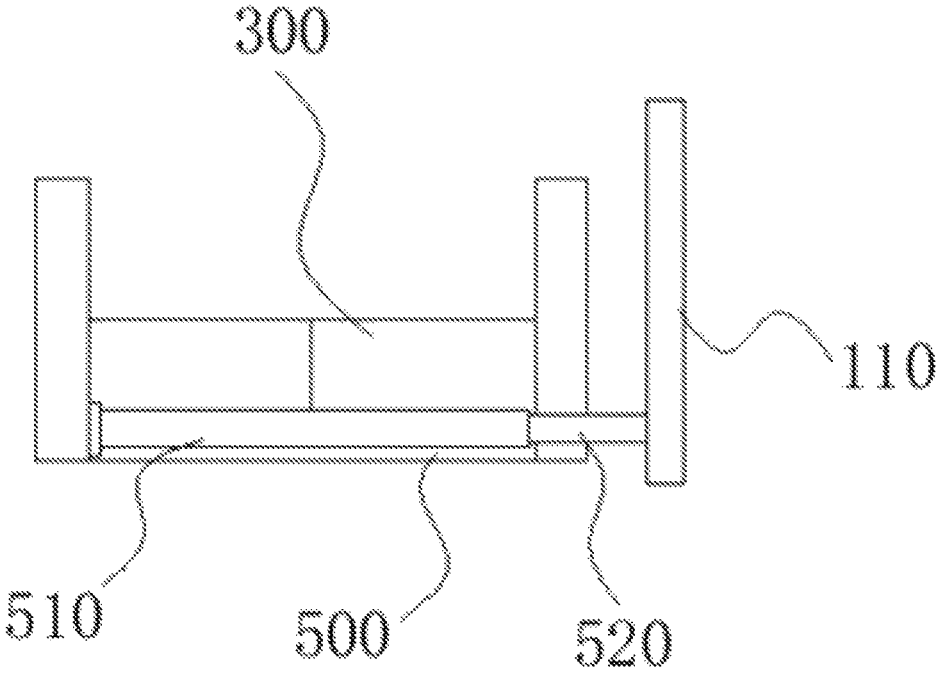
FIG. 8 is a schematic structural diagram of a telescopic structure provided by the embodiments of the present disclosure.

Referring to FIG. 6 to FIG. 8, in some optional embodiments, the drawer 300 includes a storage box 310 and a thermal insulation plate 320. The storage box 310 is arranged in the accommodating cavity 400, and can be pulled out along any one of the plurality of openings 200; and the thermal insulation plate 320 is arranged at an end of a pull-out direction of the storage box 310. In this way, the user can place food needing to be refrigerated in the storage box 310, and the thermal insulation plate 320 can reduce the cold loss in the storage box 310. The storage box 310 can be pulled out along any one of the plurality of openings 200, which is convenient for taking and placing the food and enhances the experience of the user.

Optionally, a handle 321 is arranged on the thermal insulation plate 320. In this way, the user pulls out/pushes in the thermal insulation plate 320 conveniently through the handle 321 to pull out/push in the storage box 310, which is convenient for taking and placing the food and enhances the experience of the user.

Optionally, the handle 321 is arranged on a side, facing away from the storage box 310, of the thermal insulation plate 320. In this way, an operation for the handle 321 is facilitated.

Optionally, an antiskid sleeve 322 is arranged on the handle 321. In this way, when the handle 321 is pulled out from the low-temperature accommodating cavity 400 to an external environment, water will condense on a surface of the handle 321. The arrangement of the antiskid sleeve 322 increases a friction force on the surface of the handle 321, which is convenient for the operation of the handle 321.

Optionally, the antiskid sleeve 322 is a rubber sleeve. In this way, the rubber sleeve has a relatively good antiskid effect and is readily available, so that the production cost is reduced.

Optionally, penetration slots 150 corresponding to the handle 321 are formed in the first sealing door 110 and/or the second sealing door 120. In this way, the handle 321 arranged on the thermal insulation plate 320 is arranged in the penetration slots 150 on the first sealing door 110 and/or the second sealing door 120 in a penetrating manner. When the handle 321 is operated to pull out the drawer 300, the first sealing door 110 and/or the second sealing door 120 are also pulled out, which is convenient for taking and placing food and enhances the experience of the user.

Optionally, a sealing pad 151 is arranged on a side, facing the thermal insulation plate 320, of the penetration slot 150. In this way, when the handle 321 passes through the penetration slot 150, the handle 321 is combined with the sealing pad 151 to seal the penetration slot 150 to reduce the cold loss in the accommodating cavity 400.

Optionally, the sealing pad 151 is annular, and surrounds an edge of a side, facing the thermal insulation plate 320, of the penetration slot 150. In this way, the sealing effect of the sealing pad 151 is enhanced, and the cold loss in the accommodating cavity 400 is reduced.

Optionally, a length of the handle 321 protruding from the thermal insulation plate 320 is greater than the depth of the penetration slot 150. In this way, after the handle 321 passes through the penetration slots 150, a part of the handle 321 would still protrude from the first sealing door 110 and/or the second sealing door 120, which is convenient for the user to operate the handle 321 to pull out/push in the drawer 300.

Optionally, the first sealing door 110 and/or the second sealing door 120 are connected with the drawer 300 through telescopic structures 500. In this way, when the first sealing door 110 and/or the second sealing door 120 are pulled out, the first sealing door 110 and/or the second sealing door 120 can be supported through the telescopic structures 500, so as to prevent the first sealing door 110 and/or the second sealing door 120 from losing the support and falling off, which is convenient for taking and placing the food and enhances the experience of the user.

Optionally, the telescopic structure 500 includes a collection part 510 and a telescopic part 520. The collection part 510 is arranged on a side wall of the drawer 300. One end of the telescopic part 520 is telescopically arranged in the collection part 510, and the other end of the telescopic part 520 is connected with the first sealing door 110 and/or the second sealing door 120. In this way, when the first sealing door 110 and/or the second sealing door 120 are pulled out, the telescopic part 520 connected therewith extends out of the collection part 510; when the first sealing door 110 and/or the second sealing door 120 are pushed in, the telescopic part 520 connected therewith retracts into the collection part 510; and therefore, the first sealing door 110 and/or the second sealing door 120 are supported through the telescopic parts 520, so as to prevent the first sealing door 110 and/or the second sealing door 120 from losing the support and falling off, which is convenient for taking and placing the food and enhances the experience of the user.

Optionally, the lengths of the collection part 510, the telescopic part 520 and the drawer 300 are equal in a horizontal direction. In this way, the drawer 300 connected with the telescopic part 520 can be pulled out in a relative pull-out direction, which is convenient for taking and placing the food.

Optionally, the collection part 510 is of a cylindrical structure. In this way, the telescopic part 520 extends out of or retracts in the collection part 510.

Optionally, the telescopic part 520 is of a circularly tubular structure. In this way, the telescopic part 520 can extend out of or retract in the collection part 510 due to its relatively small mass.

Figure 9:
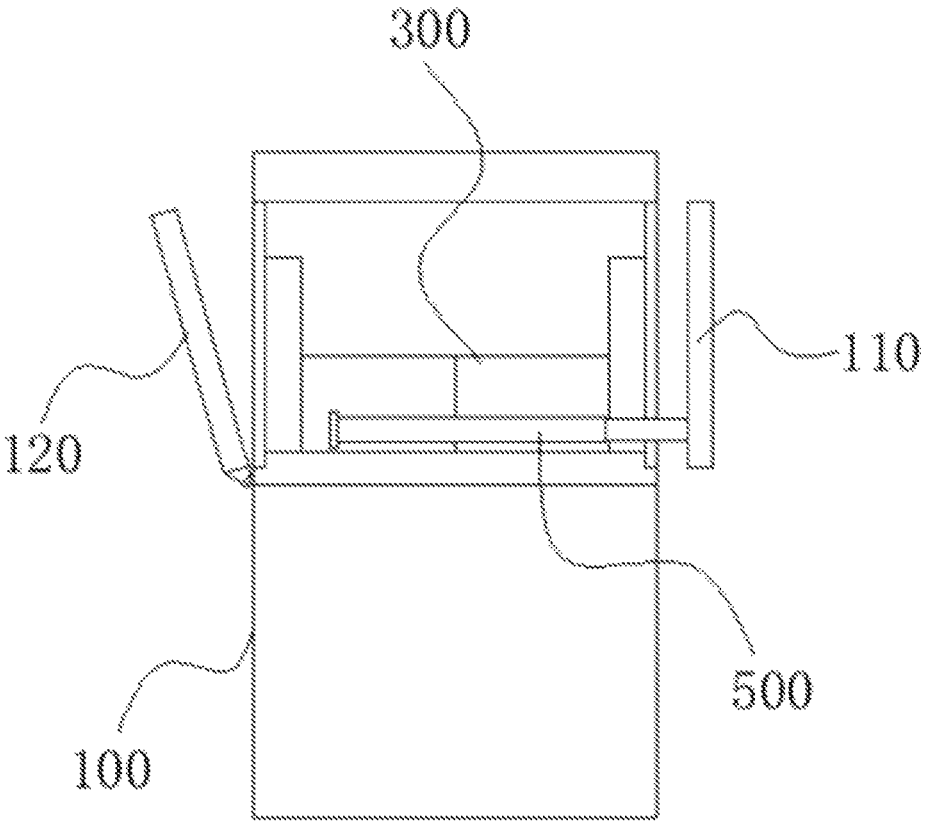
FIG. 9 is a schematic structural diagram of another refrigerator provided by the embodiments of the present disclosure.
Figure 10:
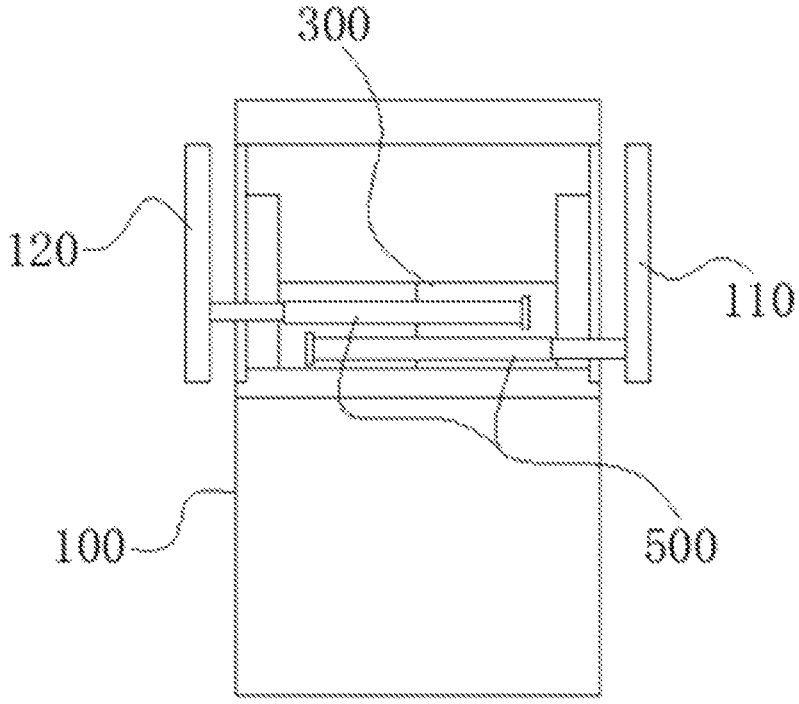
FIG. 10 is a schematic structural diagram of another refrigerator provided by the embodiments of the present disclosure.
Figure 11:
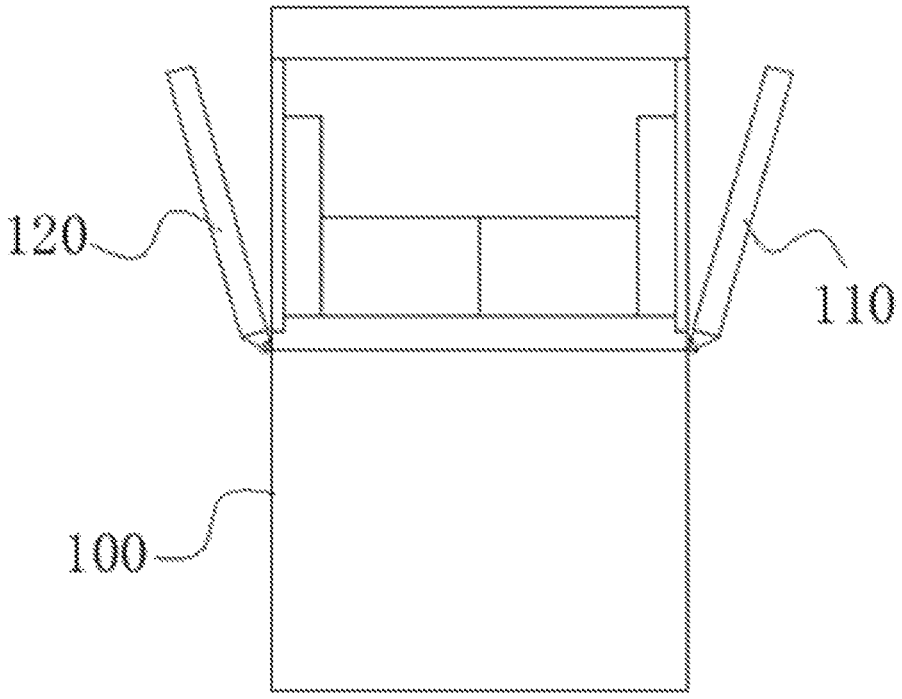
FIG. 11 is a schematic structural diagram of another refrigerator provided by the embodiments of the present disclosure.

Referring to FIG. 9 to FIG. 11, in some optional embodiments, the first sealing door 110 is connected with the drawer 300 and can be pulled out along with the drawer 300, and the second sealing door 120 is connected with the housing 100 and can be flipped along the housing 100 to be opened. In this way, the first sealing door 110 can be pulled out along with the drawer 300 for taking and placing the food; or, the second sealing door 120 can be flipped to be opened for taking and placing the food at the opening 200 closed by the second sealing door 120. This is convenient for taking and placing the food and enhances the experience of the user.

Optionally, the first sealing door 110 is connected with the drawer 300 through the telescopic structure 500, and the second sealing door 120 is connected with the housing 100 through a hinge. In this way, the first sealing door 110 can be pulled out along with the drawer 300, and the second sealing door 120 can be flipped to be opened. This is convenient for taking and placing the food.

Optionally, both the first sealing door 110 and the second sealing door 120 are connected with the drawer 300 and can be pulled out along with the drawer 300. In this way, both the first sealing door 110 and the second sealing door 120 can be pulled out along with the drawer 300, and the user can selectively pull out the drawer 300 from the opening 200 corresponding to the first sealing door 110 or the second sealing door 120 for taking and placing the food, so that the experience of the user is enhanced.

Optionally, both the first sealing door 110 and the second sealing door 120 are connected with the drawer 300 through telescopic structures 500. In this way, both the first sealing door 110 and the second sealing door 120 can be pulled out along with the drawer 300 to facilitate taking and placement of the food.

Optionally, both the first sealing door 110 and the second sealing door 120 are connected with the housing 100 and can be flipped along the housing 100 to be opened. In this way, both the first sealing door 110 and the second sealing door 120 can be flipped to be opened, and the user can selectively open the first sealing door 110 or the second sealing door 120 for taking and placing the food from the openings 200 corresponding to the doors, so that the experience of the user is enhanced.

Optionally, both the first sealing door 110 and the second sealing door 120 are connected with the housing 100 through hinges. In this way, the first sealing door 110 and the second sealing door 120 can be flipped to be opened to facilitate taking and placement of the food.

Figure 12:
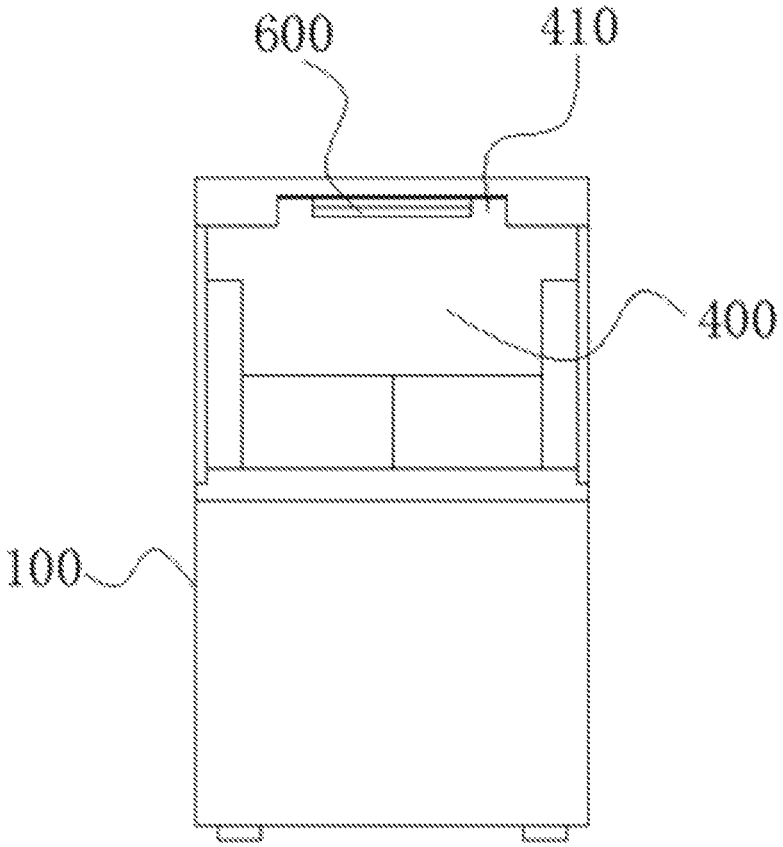
FIG. 12 is a schematic diagram of an installation structure of a refrigeration part provided by the embodiments of the present disclosure.
Figure 13:
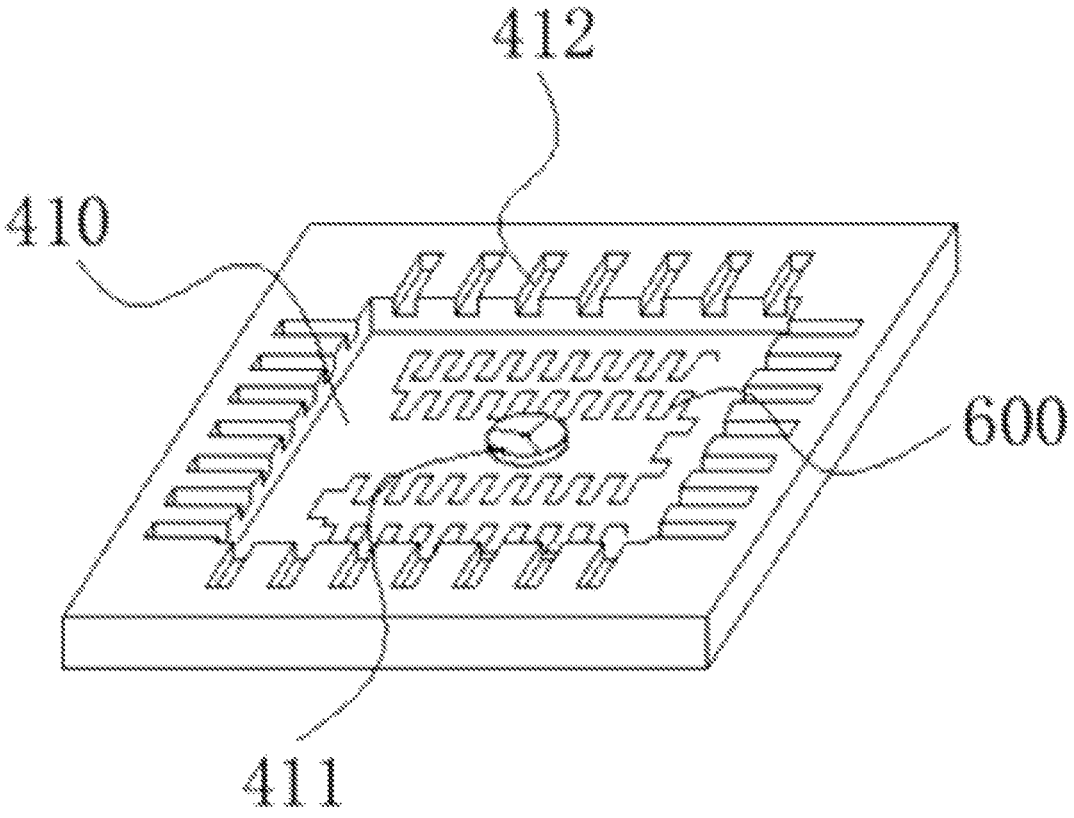
FIG. 13 is a schematic structural diagram of an upper side wall of an accommodating cavity provided by the embodiments of the present disclosure.

Referring to FIG. 12 to FIG. 13, in some optional embodiments, the refrigerator further includes a refrigeration part 600 arranged on an upper side wall of the accommodating cavity 400. In this way, the drawer 300 located in the accommodating cavity 400 faces the upper side wall of the accommodating cavity 400, so that the refrigeration part 600 is arranged in the upper side wall of the accommodating cavity 400, which is convenient for the cold radiated by the refrigeration part 600 to directly act on the food in the drawer 300 to reduce the loss of the cold, and can reduce the space occupied by the refrigeration part 600 and save the cost.

Optionally, the refrigeration part 600 communicates with a refrigeration system of the refrigerator. In this way, a refrigerant in the refrigeration system of the refrigerator is transferred into the refrigeration part 600, and the refrigerant in the refrigeration part 600 is evaporated to absorb heat, so that a large amount of heat in the accommodating cavity 400 is brought away, and the temperature in the accommodating cavity 400 is reduced to refrigerate the food.

Optionally, the refrigeration part 600 is an evaporator. In this way, the evaporator is a commonly used component in a refrigeration process and readily available, so that the production cost is reduced.

Optionally, the upper side wall of the accommodating cavity 400 is provided with a heat exchange slot 410, and the refrigeration part 600 is mounted in the heat exchange slot 410. In this way, the installation of the refrigeration part 600 is facilitated. Air in the accommodating cavity 400 exchanges heat with air in the refrigeration part 600 conveniently, which is convenient for cooling the environment in the accommodating cavity 400.

Optionally, the refrigeration part 600 is of a zigzag pipeline structure. In this way, the production cost is saved, and a radiating area of the refrigeration part 600 in the heat exchange slot 410 becomes larger to improve the heat exchange efficiency of the refrigeration part 600 and accelerate the cooling for the environment inside the accommodating cavity 400.

Optionally, the heat exchange slot 410 is rectangular, and the upper side wall is provided with a heat insulation pad. In this way, the loss of cold in the heat exchange slot 410 can be reduced.

Optionally, a fan 411 is arranged at the center position of the heat exchange slot 410. In this way, the arrangement of the fan 411 can accelerate the flowing of air flow in the heat exchange slot 410, so that the cold on the refrigeration part 600 installed in the heat exchange slot 410 is radiated into the accommodating cavity 400 faster, and the heat exchange efficiency of the refrigeration part 600 is improved.

Optionally, the fan 411 is a centrifugal fan 411. In this way, the centrifugal fan 411 can draw the air flow from an axial direction of the fan 411, and then blow out the air flow towards a circumferential direction of the fan 411, so that the air in the accommodating cavity 400 is drawn and then distributed into the heat exchange slot 410 to increase the air flow dissipation speed; the distributed air flow exchanges heat with the air in the refrigeration part 600 installed in the heat exchange slot 410, so that the heat exchange efficiency is improved, conduction of cold is accelerated, and cooling for the environment inside the accommodating cavity 400 is accelerated.

Optionally, the centrifugal fan 411 is located in the center of the refrigeration part 600. In this way, a contact area between the air flow blown by the centrifugal fan 411 and the refrigeration part 600 is larger to improve the heat exchange efficiency of the refrigeration part 600 and accelerate the cooling for the environment inside the accommodating cavity 400.

Optionally, a plurality of air ducts 412 are arranged at an edge of the heat exchange slot 410, and are outwards radiated along the edge of the heat exchange slot 410. In this way, the air flow blow by the centrifugal fan 411 is distributed along the air ducts 412 at the edge of the heat exchange slot 410, so that the air flow distribution area is larger, which accelerates the conduction of cold and accelerates the cooling for the environment inside the accommodating cavity 400.

Optionally, the plurality of air ducts 412 are arranged in the upper side wall of the accommodating cavity 400. In this way, the air flow blow by the centrifugal fan 411 is distributed along the air ducts 412 at the edge of the heat exchange slot 410, so that the air flow is distributed along the upper side wall of the accommodating cavity 400, which accelerates the conduction of cold and accelerates the cooling for the environment inside the accommodating cavity 400.

The above description and drawings fully illustrate the embodiments of the present disclosure to enable those skilled in the art to practice them. Other embodiments may include structural and other changes. The embodiments only represent possible changes. Unless explicitly required, individual components and functions are optional, and the order of operations can be changed. Parts and features of some embodiments may be included in or substituted for parts and features of other embodiments. The embodiments of the present disclosure are not limited to the structures that have been described above and shown in the drawings, and various modifications and changes can be made without departing from the scope thereof. The scope of the present disclosure is only limited by the appended claims.

What is claimed is:

1. A refrigerator comprising:

a housing comprising a plurality of side surfaces which define an accommodating cavity;

a plurality of openings respectively formed in different side surfaces;

a drawer arranged in the accommodating cavity and capable of being pulled out along any one of the openings;

a first sealing door connected with the drawer and capable of being pulled out along with the drawer, or connected with the housing and capable of being flipped along the housing to be opened, and configured to close one opening of the accommodating cavity;

a second sealing door connected with the drawer and capable of being pulled out along with the drawer, or connected with the housing and capable of being flipped along the housing to be opened, and configured to close one opening of the accommodating cavity;

a storage box arranged in the accommodating cavity and capable of being pulled out along any one of the plurality of openings; and a thermal insulation plate arranged at an end of a pull-out direction of the storage box;

wherein a handle is arranged on the thermal insulation plate; and wherein a penetration slot corresponding to the handle is formed in the first sealing door or the second sealing door.

2. The refrigerator according to claim 1, wherein the length of the handle protruding from the thermal insulation plate is greater than the depth of the penetration slot.

3. The refrigerator according to claim 2, further comprising:

a refrigeration part arranged in an upper side wall of the accommodating cavity.

4. The refrigerator according to claim 1, further comprising:

a refrigeration part arranged in an upper side wall of the accommodating cavity.

5. The refrigerator according to claim 1, wherein the handle further comprises an antiskid sleeve.

6. The refrigerator according to claim 1, further comprising a sealing pad disposed in the penetration slot.

7. The refrigerator according to claim 1, further comprising a heat exchange slot in an upper side wall of the accommodating cavity.

8. The refrigerator according to claim 7, wherein a fan is arranged at a center position of the heat exchange slot.

9. A refrigerator comprising:

a housing comprising a plurality of side surfaces which define an accommodating cavity;

a plurality of openings respectively formed in different side surfaces;

a drawer arranged in the accommodating cavity and capable of being pulled out along any one of the openings;

a first sealing door connected with the drawer and capable of being pulled out along with the drawer, or connected with the housing and capable of being flipped along the housing to be opened, and configured to close one opening of the accommodating cavity; and a second sealing door connected with the drawer and capable of being pulled out along with the drawer, or connected with the housing and capable of being flipped along the housing to be opened, and configured to close one opening of the accommodating cavity;

wherein the first sealing door is connected with the drawer and capable of being pulled out along with the drawer, and the second sealing door is connected with the housing and capable of being flipped along the housing to be opened, wherein the first sealing door or the second sealing door is connected with the drawer through telescopic structures.

10. The refrigerator according to claim 9, wherein the telescopic structure comprises:

a collection part arranged on a side wall of the drawer; and a telescopic part, one end of which is telescopically arranged in the collection part and the other end of which is connected with the first sealing door and/or the second sealing door.

11. The refrigerator according to claim 9, further comprising:

a refrigeration part arranged in an upper side wall of the accommodating cavity.

12. The refrigerator according to claim 9, further comprising:

a storage box arranged in the accommodating cavity and capable of being pulled out along any one of the plurality of openings; and a thermal insulation plate arranged at an end of a pull-out direction of the storage box.

13. The refrigerator according to claim 12, wherein a handle is arranged on the thermal insulation plate; and wherein a penetration slot corresponding to the handle is formed in the first sealing door or the second sealing door.

14. The refrigerator according to claim 13, wherein the handle further comprises an antiskid sleeve.

15. The refrigerator according to claim 13, further comprising a sealing pad disposed in the penetration slot.

16. The refrigerator according to claim 13, further comprising a heat exchange slot in an upper side wall of the accommodating cavity.

17. The refrigerator according to claim 16, wherein a fan is arranged at a center position of the heat exchange slot.

* * * * *